US006774862B2

(12) United States Patent
Mizuno et al.

(10) Patent No.: US 6,774,862 B2
(45) Date of Patent: Aug. 10, 2004

(54) MULTIBEAM ANTENNA APPARATUS

(75) Inventors: Tomohiro Mizuno, Tokyo (JP); Hiroyuki Satou, Tokyo (JP); Izuru Naitou, Tokyo (JP); Soichi Matsumoto, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 30 days.

(21) Appl. No.: 10/286,804

(22) Filed: Nov. 4, 2002

(65) Prior Publication Data

US 2003/0214451 A1 Nov. 20, 2003

(30) Foreign Application Priority Data

May 17, 2002 (JP) ..... 2002-143600

(51) Int. Cl.[7] ..... H01Q 13/00; H01Q 19/06

(52) U.S. Cl. ..... 343/781 P; 343/754; 343/756; 343/909

(58) Field of Search ..... 343/753, 754, 343/756, 781 P, 781 CA, 909

(56) References Cited

U.S. PATENT DOCUMENTS 4,062,018 A * 12/1977 Yokoi et al. ..... 343/754
4,223,316 A * 9/1980 Drabowitch ..... 343/781 P
4,435,714 A * 3/1984 Luh ..... 343/753
5,990,842 A * 11/1999 Lo Forti et al. ..... 343/756
6,404,398 B1 * 6/2002 Chen et al. ..... 343/754

FOREIGN PATENT DOCUMENTS

JP 2000-196345 7/2000 ..... H01Q/19/06

OTHER PUBLICATIONS

Masaaki Shinji, et al., "Multibeam Antenna", Magazine of Institute of Electronics and Communication Engineers of Japan, vol. 60, No. 5, pp. 544–551. (with English translation).

* cited by examiner

*Primary Examiner*—Hoang V. Nguyen
(74) *Attorney, Agent, or Firm*—Oblon, Spivak, McClelland, Maier & Neustadt, P.C.

(57) ABSTRACT

A multibeam antenna apparatus is disclosed. The multibeam antenna apparatus includes a main reflector (1), a sub-reflector (2), a focused beam feeder (3), a primary radiator array (5) having a plurality of primary radiators (5*a*), and a lens array (10) having a plurality of wavefront transformation lenses (10*a*) corresponding to the plurality of primary radiators (5*a*), respectively. The lens array (10) can be placed in the vicinity of a front end of the primary radiator array (5). As an alternative, the lens array (10) is placed in an electric wave propagation range of the focused beam feeder (3) where multiple beams which constitute a multibeam are spatially isolated from one another in terms of electric power. Thus the multibeam antenna apparatus can prevent an error from occurring in the orientation of each beam.

7 Claims, 7 Drawing Sheets

✳ : BEAM POSITION IN A FOCAL PLANE ON AN ENTRANCE SIDE OF THE FOCUSED BEAM FEEDER

• : BEAM POSITION IN A FOCAL PLANE ON AN EXIT SIDE OF THE FOCUSED BEAM FEEDER

FIG.6

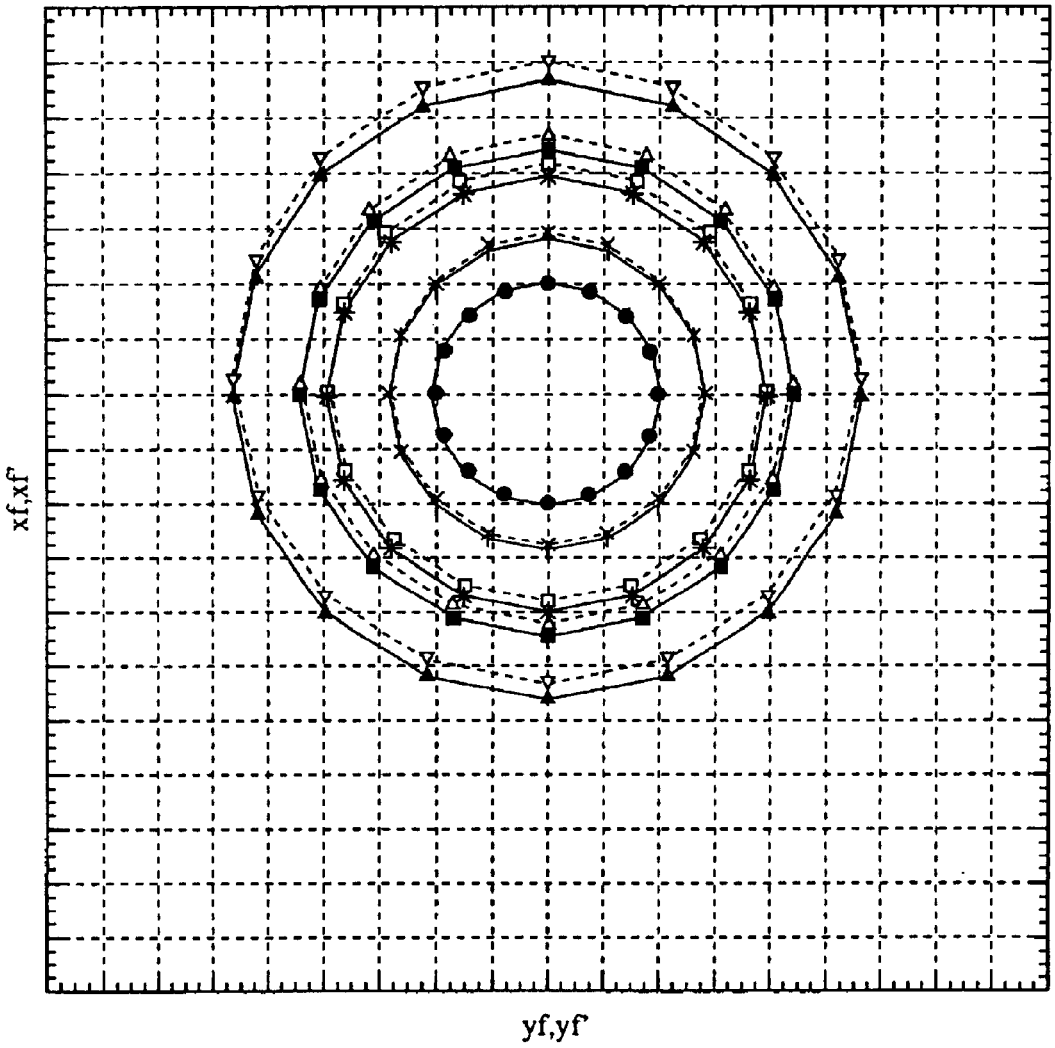

—o— : R1(BEAM POSITION IN A FOCAL PLANE ON AN ENTRANCE SIDE OF THE FOCUSED BEAM FEEDER)

—+— : R2(BEAM POSITION IN A FOCAL PLANE ON AN ENTRANCE SIDE OF THE FOCUSED BEAM FEEDER)

—✱— : R3(BEAM POSITION IN A FOCAL PLANE ON AN ENTRANCE SIDE OF THE FOCUSED BEAM FEEDER)

—■— : R4(BEAM POSITION IN A FOCAL PLANE ON AN ENTRANCE SIDE OF THE FOCUSED BEAM FEEDER)

—▲— : R5(BEAM POSITION IN A FOCAL PLANE ON AN ENTRANCE SIDE OF THE FOCUSED BEAM FEEDER)

--●-- : R1(BEAM POSITION IN A FOCAL PLANE ON AN EXIT SIDE OF THE FOCUSED BEAM FEEDER)

--×-- : R2(BEAM POSITION IN A FOCAL PLANE ON AN EXIT SIDE OF THE FOCUSED BEAM FEEDER)

--⊟-- : R3(BEAM POSITION IN A FOCAL PLANE ON AN EXIT SIDE OF THE FOCUSED BEAM FEEDER)

--▲-- : R4(BEAM POSITION IN A FOCAL PLANE ON AN EXIT SIDE OF THE FOCUSED BEAM FEEDER)

--▽-- : R5(BEAM POSITION IN A FOCAL PLANE ON AN EXIT SIDE OF THE FOCUSED BEAM FEEDER)

MULTIBEAM ANTENNA APPARATUS

BACKGROUND OF THE INVENTION

1. Field of the Invention

The present invention relates to a multibeam antenna apparatus for use in radio astronomical fields, communications, and so on.

2. Description of the Related Art

A prior art multibeam antenna apparatus is disclosed in "Multibeam antenna", Masaaki Sinji, Journal of IECE (The Institute of Electronics and Communication Engineers), 77, 5, pp. 544 to 551.

FIG. 7 is a block diagram showing the structure of a prior art multibeam antenna apparatus. In the figure, reference numeral 1 denotes a main reflector having a reflecting surface of rotationally symmetric shape, reference numeral 2 is a sub-reflector having a reflecting surface of rotationally symmetric shape, reference numeral 3 denotes a focused beam feeder, and reference numerals 3*a* to 3*d* denote focusing reflectors which constitute the focused beam feeder 3. Each of the two reflectors 3*a* and 3*b* has a mirror finished surface of rotationally quadratic surface, and each of the remaining focusing reflectors 3*c* and 3*d* has a mirror finished surface of planar shape. Furthermore, reference numeral 4*a* denotes a focal point of the focusing reflector 3*a*, reference numeral 4*b* denotes a focal point of the focusing reflector 3*b*, reference numeral 4*c* denotes an image focal point caused by the focusing reflector 3*c*, which corresponds to the focal point 4*a*, reference numeral 4*d* denotes an image focal point caused by the focusing reflector 3*d*, which corresponds to the focal point 4*b*, reference numeral 5 denotes a primary radiator array, reference numeral 5*a* denotes each of a plurality of primary radiators which constitute the primary radiator array 5, reference numeral 6 denotes a transceiver connected to the primary radiator array 5, reference numeral 7 denotes an elevation angle rotation axis, reference numeral 8 denotes a bearing angle rotation axis, and reference numeral 9 denotes an antenna pedestal for securing the focused beam feeder 3, the primary radiator array 5, and the transceiver 6.

Next, a description will be made as to the operation of the prior art multibeam antenna apparatus. The multibeam antenna apparatus as shown in FIG. 7 uses the primary radiator array 5, which consists of the plurality of primary radiators 5*a*, for the main reflector 1, the sub-reflector 2, and the focused beam feeder 3, which implement a single mirror finished surface structure, in order to measure electric waves from a plurality of celestial objects or satellites at the same time. Electric waves, which come from different directions and then reach the multibeam antenna apparatus at the same time, are reflected and focused by the main reflector 1, so that they reach the primary radiator array 5 by way of the sub-reflector 2 and the focused beam feeder 3, and are received by the plurality of primary radiators 5*a* corresponding to the respective directions in which the electric waves are travelling, respectively. Thus a multibeam is implemented. The plurality of primary radiators 5*a* are arranged so that the orientation of each of multiple beams which constitute the multibeam agrees with a desired direction in which a corresponding electric wave is travelling.

When celestial objects are observed from the ground by using the multibeam antenna apparatus, for example, the directions of the objects to be measured change during measurements because the positions of the celestial objects on the celestial sphere rotate around the North Pole or the South Pole of the heaven under the influence of the spin of the earth and so on. In this case, while changing the orientation of the main reflector 1 so that it agrees with the direction of the center of gravity of the plurality of objects to be measured, for example, and tracking these objects to be measured, the prior art multibeam antenna apparatus receives electric waves from the objects to be measured. Because a relation between the relative positions of the plurality of objects to be measured rotates around the North Pole or the South Pole of the heaven while being maintained on the celestial sphere, the direction of each of the plurality of objects to be measured when viewed from the antenna rotates with respect to the direction of the center of gravity of the plurality of objects to be measured, too. It is therefore necessary to relatively rotate the arrangement of each of the plurality of primary radiators 5*a*, which corresponds to an electric wave from each of the plurality of celestial objects, and it is necessary to rotate the whole of the primary radiator array 5 so as to make a view rotation correction.

Because the prior art multibeam antenna apparatus is constructed as above, an electric wave from each of a plurality of objects to be measured is focused, byway of the main reflector 1 and the sub-reflector 2, to a position in the vicinity of the focal point 4*c*, which corresponds to the direction in which the electric wave is travelling to the multibeam antenna apparatus. When each of the main reflector 1 and the sub-reflector 2 has a rotationally symmetric shape, if the directions in which electric waves from the plurality of objects to be measured are travelling to the multibeam antenna apparatus are rotationally symmetric with respect to the optical axis of the main reflector 1, the positions onto which the electric waves corresponding to the multiple beams are focused are also rotationally symmetric with respect to the optical axis of the main reflector 1. An electric wave travelling in each beam direction which has been focused in this vicinity of the focal point 4*c* continues to be travelling while spreading and is focused again in the vicinity of the focal point 4*d* after passing through the focused beam feeder 3.

The directions in which electric waves are travelling in the focused beam feeder 3, which correspond to the orientations of multiple beams, respectively, become rotationally asymmetric with respect of the optical axis of the focused beam feeder 3 because of the focusing reflectors of offset type. As a result, even if the positions onto which electric waves are focused before being incident upon the focused beam feeder 3 are rotationally symmetric with respect to the optical axis of the main reflector 1, the positions onto which the electric waves are focused after exiting from the focused beam feeder 3 do not become rotationally symmetric with respect to the optical axis of the focused beam feeder 3, but have a distorted pattern. A problem is therefore that even if the plurality of primary radiators 5*a* which constitute the primary radiator array 5 are arranged so that they are rotationally symmetric with respect to the optical axis of the focused beam feeder 3, the orientations of the multiple beams in the multibeam antenna apparatus do not become rotationally symmetric with the optical axis of the focused beam feeder 3 and there causes a distortion in the orientations of the multiple beams.

Another problem is that when rotating the whole of the primary radiator array 5 for view rotation correction, the orientation of each beam varies according to the rotation of the primary radiator array 5 because of the rotational asymmetry of the orientation of each beam.

SUMMARY OF THE INVENTION

The present invention is proposed to solve the above-mentioned problems, and it is therefore an object of the present invention to provide a multibeam antenna apparatus capable of preventing an error from occurring in the orientation of each beam.

In accordance with an aspect of the present invention, there is provided a multibeam antenna apparatus including a primary radiator array having a plurality of primary radiators and a lens array having a plurality of wavefront transformation lenses corresponding to the plurality of primary radiators, respectively. Preferably, the lens array is placed in the vicinity of a front end of the primary radiator array. As an alternative, the lens array is placed in an electric wave propagation range of a focused beam feeder where multiple beams are spatially isolated from one another in terms of electric power.

Thus the multibeam antenna apparatus according to the present invention can prevent an error from occurring in the orientation of each of multiple beams which constitute a multibeam.

Further objects and advantages of the present invention will be apparent from the following description of the preferred embodiments of the invention as illustrated in the accompanying drawings.

BRIEF DESCRIPTION OF THE DRAWINGS

FIG. 6 is an explanatory drawing for showing the occurrence of errors in the orientations of multiple beams when a view rotation correction is made, in which the position of each focused beam changes before and after each focused beam passes through a focused beam feeder when a view rotation is done.

DETAILED DESCRIPTION OF THE PREFERRED EMBODIMENTS

The invention will be now described with reference to the accompanying drawings.

Embodiment 1.

Figure 1:
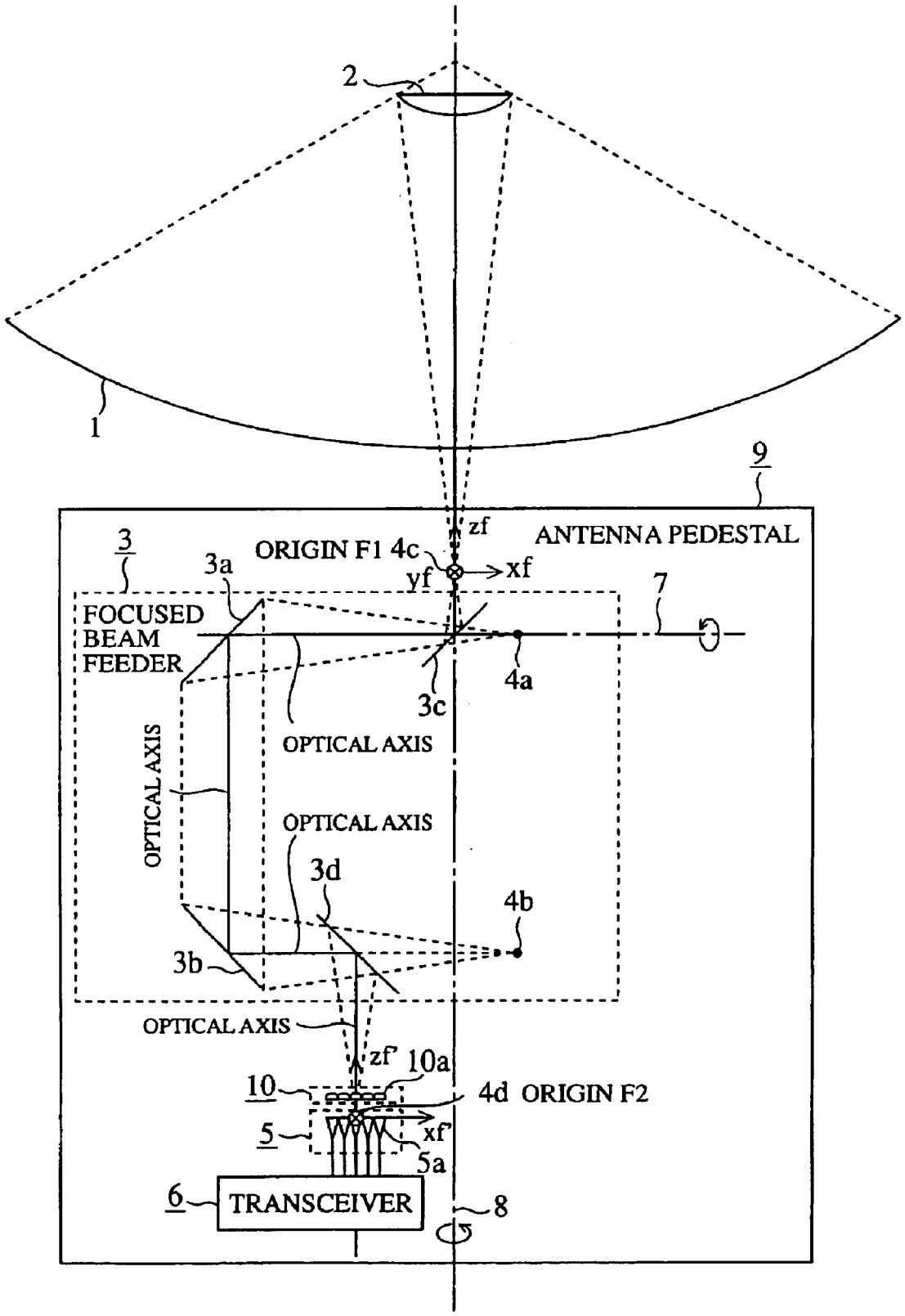
FIG. 1 is a block diagram showing the structure of a multibeam antenna apparatus according to embodiment 1 of the present invention.

FIG. 1 is a block diagram showing the structure of a multibeam antenna apparatus according to embodiment 1 of the present invention. In the figure, reference numeral 1 denotes a main reflector having a reflecting surface of rotationally symmetric shape, reference numeral 2 denotes a sub-reflector having a reflecting surface of rotationally symmetric shape, reference numeral 3 denotes a focused beam feeder, and reference numerals 3*a* to 3*d* denote focusing reflectors which constitute the focused beam feeder 3, respectively. Each of the two focusing reflectors 3*a* and 3*b* has a mirror finished surface of rotationally quadratic surface, and each of the remaining focusing reflectors 3*c* and 3*d* has a mirror finished surface of planar shape. Furthermore, reference numeral 4*a* denotes a focal point of the focusing reflector 3*a*, reference numeral 4*b* denotes a focal point of the focusing reflector 3*b*, reference numeral 4*c* denotes an image focal point caused by the focusing reflector 3*c*, which corresponds to the focal point 4*a*, reference numeral 4*d* denotes an image focal point caused by the focusing reflector 3*d*, which corresponds to the focal point 4*b*, reference numeral 5 denotes a primary radiator array, reference numeral 5*a* denotes each of a plurality of primary radiators which constitute the primary radiator array 5, reference numeral 6 denotes a transceiver connected to the primary radiator array 5, reference numeral 7 denotes an elevation angle rotation axis, reference numeral 8 denotes a bearing angle rotation axis, reference numeral 9 denotes an antenna pedestal for securing the focused beam feeder 3, the primary radiator array 5, and the transceiver 6, reference numeral 10 denotes a lens array, and reference numeral 10*a* denotes each of a plurality of wavefront transformation lenses which constitute the lens array 10.

For purposes of illustration, a rectangular coordinate system (F1-xf, yf, zf) is defined, where the focal point 4*c* is set to an origin F1, the z axis is parallel with the bearing angle rotation axis 8, and the x axis is parallel with the elevation angle rotation axis 7. A further rectangular coordinate system (F2-xf', yf', zf') is also defined, where the focal point 4*d* is set to an origin F2, the z axis is parallel with a direction extending from the focal point 4*d* to an intersection of the focusing reflector 3*d* and the optical axis of a beam incident upon the focusing reflector 3*d*, and the y axis is orthogonal to the optical axis of a beam incident upon the focusing reflector 3*d* and the optical axis of a beam reflected by the focusing reflector 3*d*.

Figure 2:
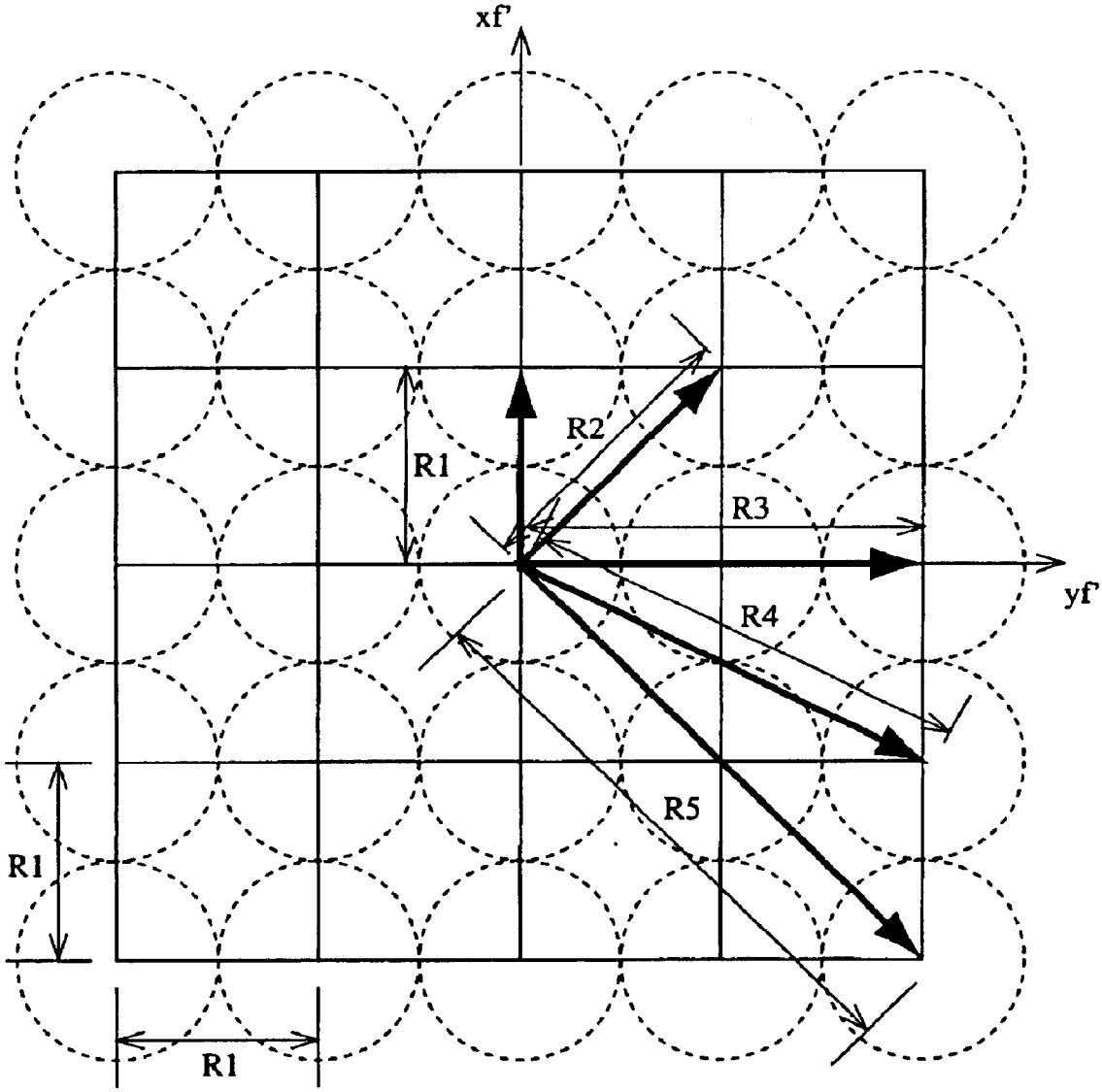
FIG. 2 is a view showing an arrangement of a plurality of primary radiators which constitute a primary radiator array included in the multibeam antenna apparatus according to embodiment 1 of the present invention.
Figure 3:
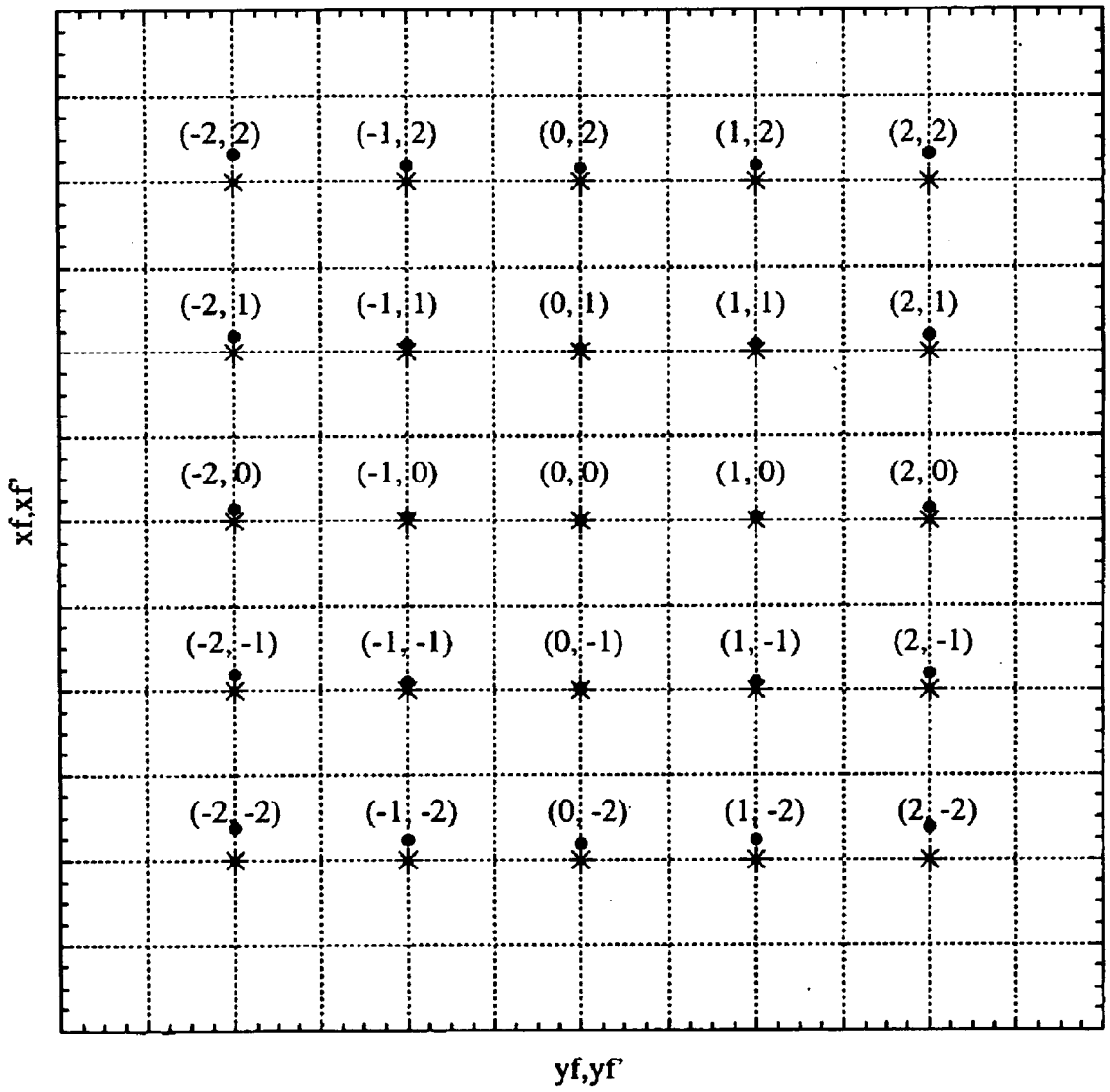
FIG. 3 is an explanatory drawing for showing the occurrence of errors in the orientations of multiple beams, in which the position of each focused beam changes between two cases with and without a focused beam feeder.

Next, a description will be made as to the operation of the multibeam antenna apparatus according to embodiment 1 of the present invention. The principle behind the multibeam antenna apparatus according to this embodiment 1 will be explained with reference to the accompanying drawings. FIG. 2 is a view showing an arrangement of the plurality of primary radiators 5*a* which constitute the primary radiator array 5. In the exemplary arrangement of FIG. 2, 25 primary radiators 5*a* are arranged in the form of an equally spaced array in the xf'-yf' plane of the coordinate system (F2-xf', yf', zf') defined by the focal point 4*d*. FIG. 3 is a diagram showing positions onto which electric waves are focused in the xf-yf plane of the coordinate system (F1-xf, yf, zf) defined by the focal point 4*c* after being emitted from the plurality of primary radiators 5*a*, being directly incident upon the focused beam feeder 3 without passing through the lens array 10, and being emitted from the focused beam feeder 3, those positions being determined by keeping track of rays based on the exemplary arrangement of FIG. 2.

It is understood from FIG. 3 that the positions onto which electric waves corresponding to multiple beams which constitute a multibeam are focused are not maintained constant before and after those electric waves pass through the focused beam feeder 3, and a distortion occurs in the positions (referred to as electric wave focused positions from here on) onto which electric waves corresponding to multiple beams which constitute a multibeam are focused. The distortion that occurs in the electric wave focused positions is determined by the structure of the focused beam feeder 3 and the shape of each of the plurality of focusing reflectors 3*a* to 3*d*. As explained in Description of the Related Art, the focusing reflectors 3*a* to 3*d* that are of offset type make the directions of propagation of electric waves corresponding to the orientations of the multiple beams in the focused beam feeder 3 be rotationally asymmetric with respect to the optical axis of the focused beam feeder 3. As a result, the orientation of each beam becomes distorted in the multibeam antenna apparatus if no correction is made to the orientation of each beam. Though the distortion of the orientation of each beam can be corrected if the plurality of primary radiators 5*a* are rearranged according to the distortion of the electric wave focused positions, there causes other problems: a feed for connecting the plurality of primary radiators 5*a* to the transceiver 6 becomes complex and the physical interference of beams occurs due to restrictions on the size of each primary radiators 5*a*.

Figure 4:
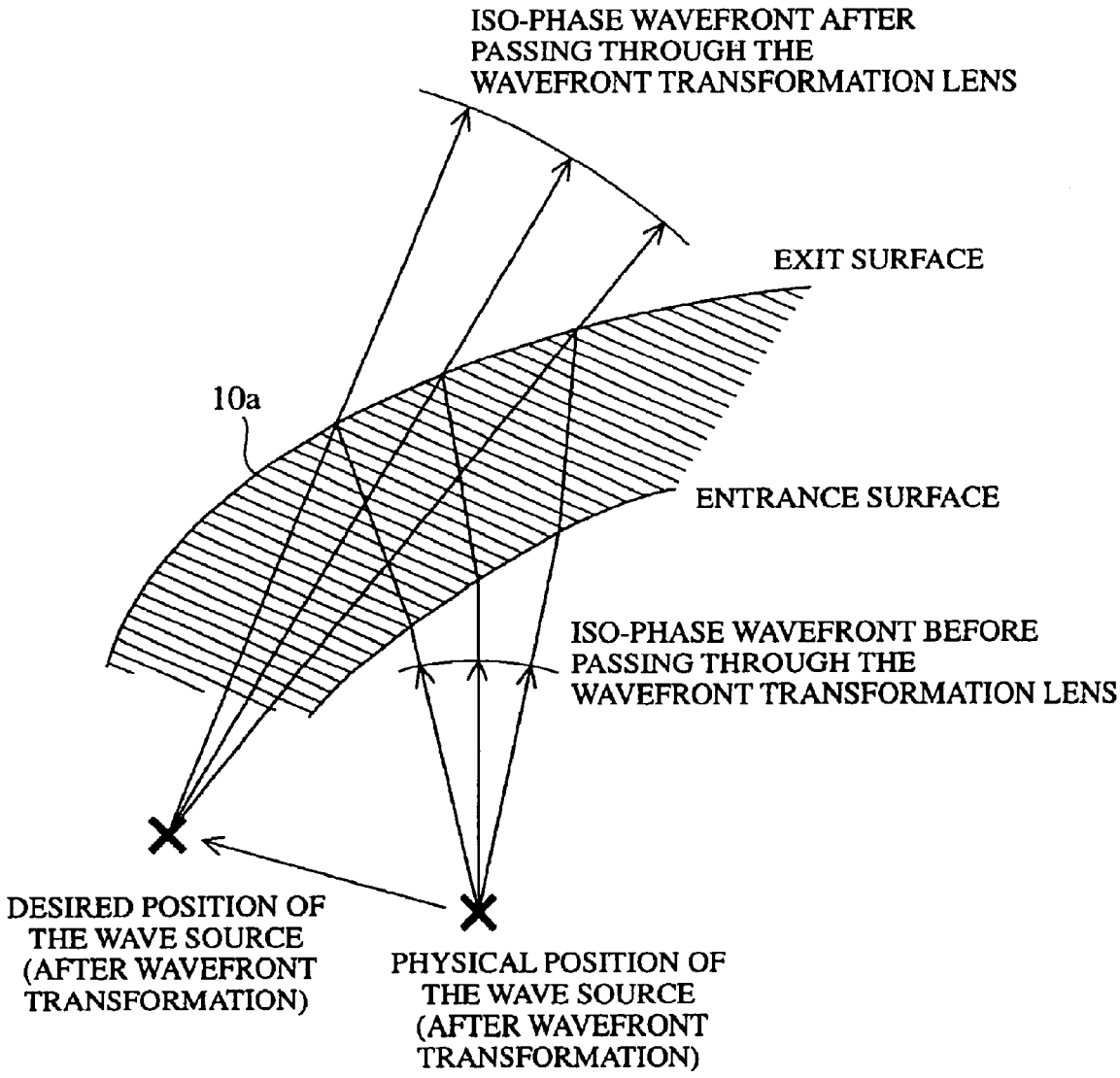
FIG. 4 is an explanatory drawing for showing the action of a wavefront transformation lens.

In accordance with the present invention, in order to correct the distortion of the orientation of each beam, a wavefront transformation lens 10*a* is used. FIG. 4 shows an explanatory drawing of such a wavefront transformation lens. A wavefront transformation lens 10*a* transforms the wavefront of an electric wave emitted from an arbitrary wave source and being incident thereupon so that it is travelling from another wave source, and changes the center position of the curvature of the wavefront of the electric wave. The shape of the wavefront transformation lens 10*a* can be determined based on the law of refraction and on the condition that the optical path length is constant.

In order to prevent an error from occurring in the orientation of each beam, the wave front transformation lens 10*a* only has to transform the iso-phase wavefront of an electric wave from each primary radiator 5*a*, which is a physical wave source, into an iso-phase wavefront which an electric wave that originates from a wave source placed at a desired position has. The desired position is a distorted position onto which the corresponding electric wave would be focused by way of the focused beam feeder 3 when the lens array 10 is omitted, and can be determined by keeping track of rays in the focused beam feeder 3.

The lens array 10 having a plurality of wavefront transformation lenses 10*a* must be placed at a position where a plurality of beams which constitute a multibeam are fully isolated from one another in terms of electric power. In general, because electric waves travel while spreading, in order to suppress the influence of adjacent beams to a minimum, it is preferable to place a corresponding wavefront transformation lens 10*a* in the vicinity of an front end of each of the plurality of primary radiators 5*a* where each of the plurality of beams is most surely isolated from the other beams in terms of electric power.

Even when the focused beam feeder 3 has a different structure, for example, even when the focused beam feeder 3 is constructed of only lenses other than focusing reflectors, or a combination of focusing reflectors and lenses, an error can be prevented from occurring in the orientation of each beam. The main reflector 1 and the sub-reflector 2 as shown in FIG. 1 can be of Gregorian type other than Cassegrain type. In addition, in order to improve the efficiency of each of the main reflector 1 and the sub-reflector 2, each of the main reflector 1 and the sub-reflector 2 can have a modified shape.

The above description is directed to the case where the multibeam antenna apparatus functions as a transmitting antenna. Even when the multibeam antenna apparatus functions as a receiving antenna, the multibeam antenna apparatus can similarly prevent an error from occurring in the orientation of each beam according to reversibility of the antenna.

Embodiment 2.

Figure 5:
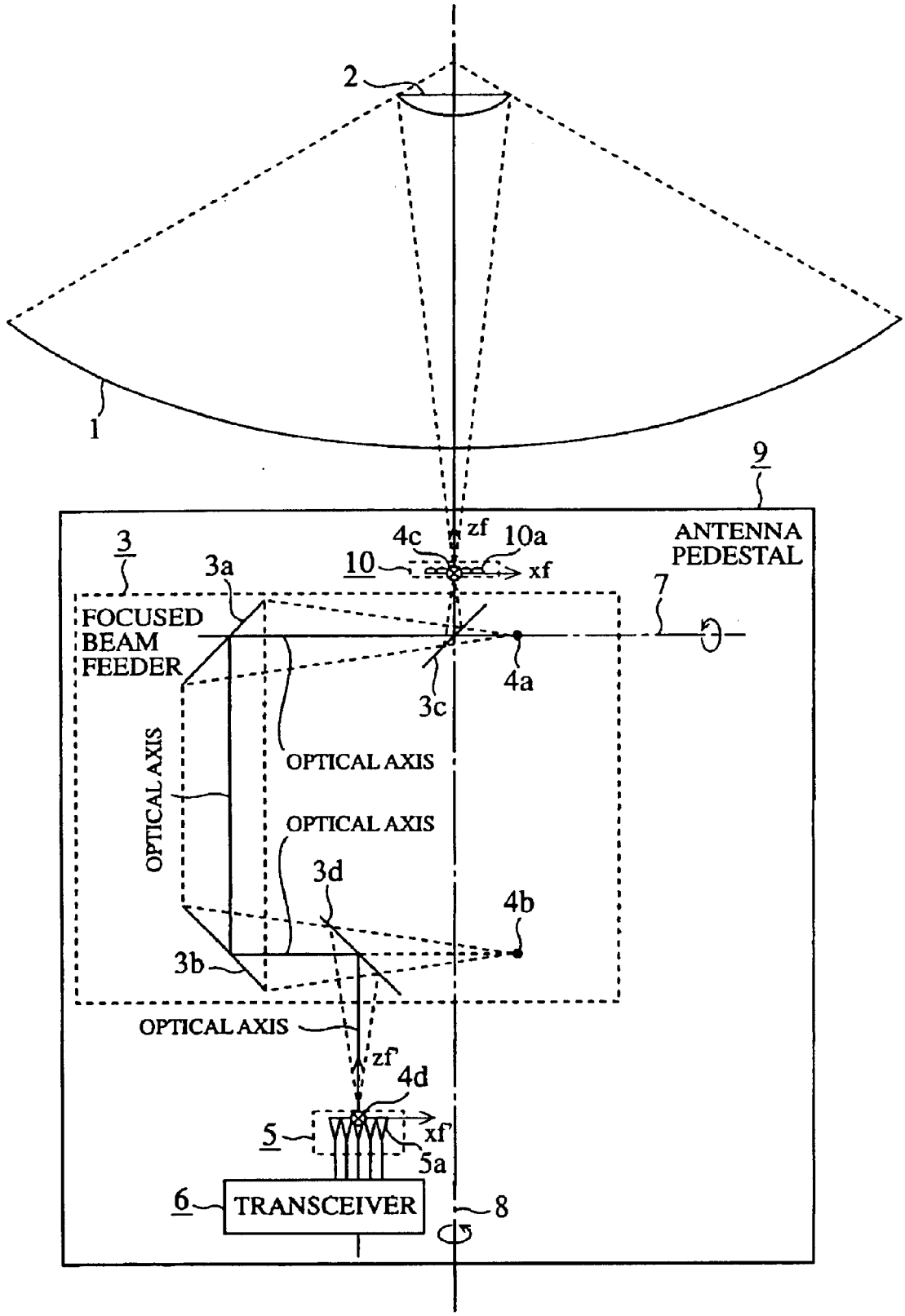
FIG. 5 is a block diagram showing the structure of a multibeam antenna apparatus according to embodiment 2 of the present invention.
Figure 7:
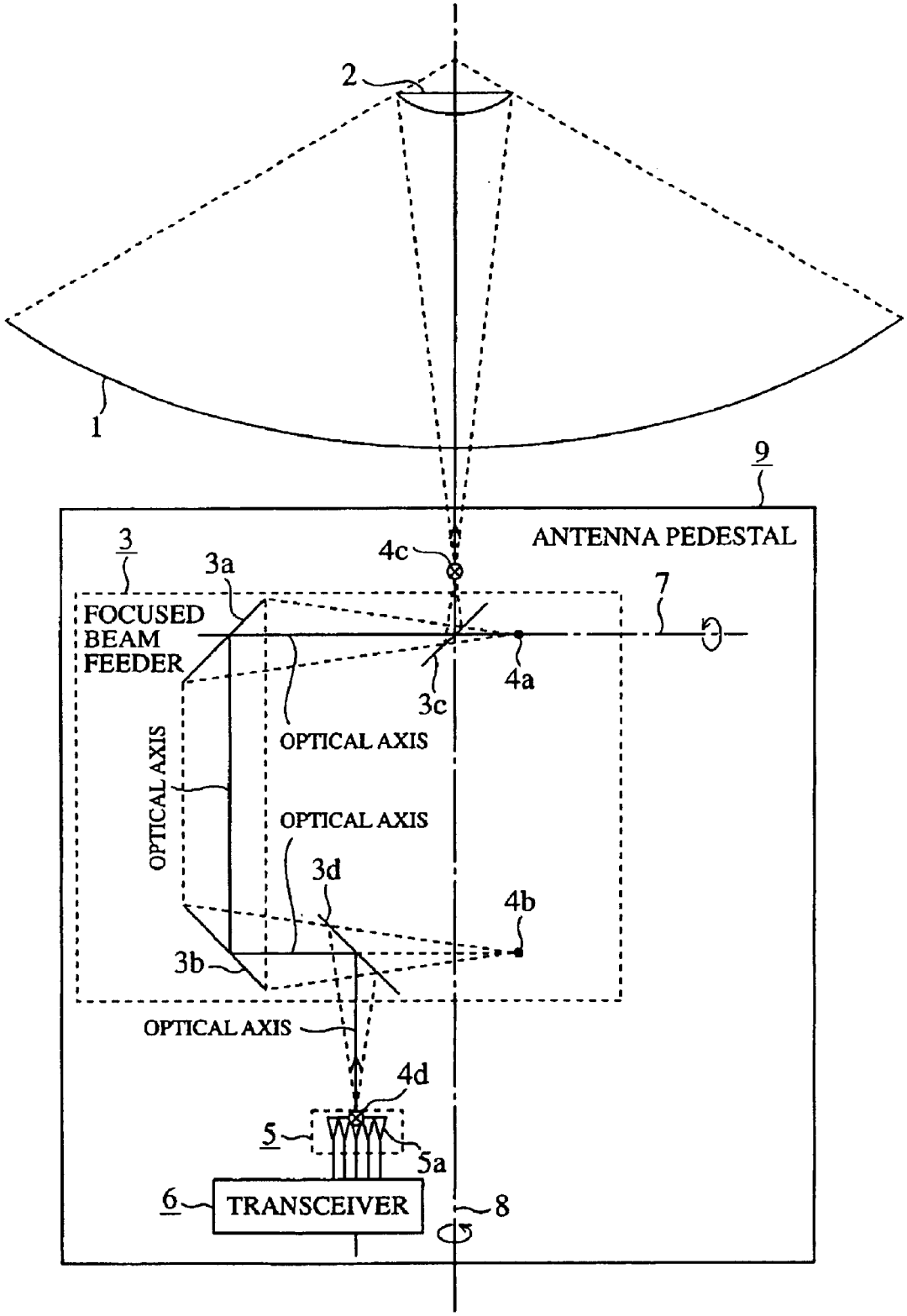
FIG.7 (PRIOR ART)
FIG. 7 is a block diagram showing the structure of a prior art multibeam antenna apparatus.

FIG. 5 is a block diagram showing the structure of a multibeam antenna apparatus according to embodiment 2 of the present invention. In the figure, all components of the multibeam antenna apparatus are the same as those of the multibeam antenna apparatus as shown in FIG. 1, and the explanation of those components will be omitted hereafter.

In accordance with this embodiment 2, a lens array 10 is not placed in the vicinity of a front end of a primary radiator array 5, but is placed at a position in the vicinity of a focal point 4*c*, onto which electric waves passing through a focused beam feeder 3 are focused. Embodiment 2 offers the same advantage of being able to prevent an error from occurring in the orientation of each beam, as provided by above-mentioned embodiment 1.

Next, a description will be made as to the operation of the multibeam antenna apparatus according to embodiment 2 of the present invention. Because the electric power of each beam is fully focused in the vicinity of the focal point 4*c* of the optical system included in the multibeam antenna apparatus, the influence of adjacent beams can be suppressed. Therefore, even when the distance between the primary radiator array 5 and a focusing reflector 3*d* is very short and the lens array 10 cannot be placed physically, an error can be prevented from occurring in the orientation of each beam.

As an alternative, when there exists a position onto which electric waves are focused in the focused beam feeder 3, the lens array 10 can be placed at the position. Even in this case, an error can be prevented from occurring in the orientation of each beam.

Embodiment 3.

A multibeam antenna apparatus according to embodiment 3 will be explained with reference to FIGS. 1, 2, and 6. The multibeam antenna apparatus according to this embodiment 3 has the same structure as that of above-mentioned embodiment 1 as shown in FIG. 1. The multibeam antenna apparatus is further provided with a rotating mechanism (not shown in the figures) for rotating a primary radiator array 5 and a lens array 10 for view rotation correction, and another rotating mechanism (not shown in the figures) for rotating each of a plurality of wavefront transformation lenses 10*a* which constitute the lens array 10 around a rotation axis of each of the plurality of wavefront transformation lenses 10*a*.

As previously mentioned in Description of the Related Art, when celestial objects or the like are observed from the ground by using the multibeam antenna apparatus, the direction of each of the plurality of objects to be measured rotates with respect to the direction of the center of gravity of the plurality of objects to be measured when viewed from the antenna. It is therefore necessary to rotate the whole of the primary radiator array 5 so as to make a view rotation correction.

Next, a description will be made as to the operation of the multibeam antenna apparatus according to embodiment 3 of the present invention. For example, when 25 primary radiators 5*a* are arranged in the form of an equally spaced array, as shown in FIG. 2, and the center of the primary radiator array 5 is placed on the optical axis of a focused beam feeder 3, each of the plurality of primary radiators 5*a* of the primary radiator array 5 has one of five possible distances R1 to R5 to the center of the primary radiator array 5. FIG. 6 is a diagram showing the view rotation angle characteristics of the positions onto which electric waves emitted from the plurality of primary radiators 5*a* which are arranged away from the center of the primary radiator array 5 are focused after being directly incident upon and passing through the focused beam feeder 3 without passing through the lens array 10. In this figure, there are illustrated both the position in an xf'-yf' plane defined by a focal point 4*d*, onto which an electric wave emitted from each primary radiator 5*a* is focused and the position in an xf-yf plane defined by a focal point 4*c*, onto which an electric wave exiting from the focused beam feeder 3 is focused, for the five possible distances R1 to R5, those positions being calculated based on tracking of rays travelling from each primary radiator 5*a* to the focal point 4*c*.

As can be seen from FIG. 6, the difference between the position in the xf'-yf' plane defined by the focal point 4*d*, onto which an electric wave emitted from each primary radiator 5*a* is focused and the position in the xf-yf plane defined by the focal point 4*c*, onto which an electric wave exiting from the focused beam feeder 3 is focused, i.e., the distortion of each electric wave focused position increases according to the distance between each primary radiator 5*a* and the center of the primary radiator array 5. On the other hand, the direction of xf in the figure is predominant in the direction that is extending from the position in the xf'-yf' plane defined by the focal point 4*d*, at which an electric wave emitted from each primary radiator 5*a* is focused, to the position in the xf-yf plane defined by the focal point 4*c*, at which an electric wave exiting from the focused beam feeder 3 is focused, and that does not vary according to view rotation angles.

In accordance with this embodiment 3, the multibeam antenna apparatus rotates the whole of the primary radiator array 5 around a rotation axis of the primary radiator array 5 for view rotation correction and also rotates the whole of the lens array 10 around the same rotation axis in the same direction by only the same angle as that by which the whole of the primary radiator array 5 is rotated. The multibeam antenna apparatus further rotates each of the plurality of wavefront transformation lenses 10*a* which constitute the lens array 10 around a rotation axis of each of the plurality of wavefront transformation lenses 10*a* in an opposite direction by only the same angle as that by which the whole of the primary radiator array 5 is rotated. Thus the attitude of each of the plurality of wavefront transformation lenses 10*a* which constitute the lens array 10 is maintained constant with respect to the focused beam feeder 3 even if the whole of the lens array 10 is rotated.

Therefore, when a view rotation correction is made, the orientation of each beam does not vary even if the view rotation angle changes, and an error can be prevented from occurring in the orientation of each beam.

Embodiment 4.

A multibeam antenna apparatus according to embodiment 4 will be explained with reference to FIGS. 1 and 6. The multibeam antenna apparatus according to this embodiment 4 has the same structure as that of above-mentioned embodiment 1 as shown in FIG. 1. The multibeam antenna apparatus is further provided with a rotating mechanism (not shown in the figures) for rotating a primary radiator array 5 and a lens array 10 for view rotation correction, and another rotating mechanism (not shown in the figures) for rotating each of a plurality of wavefront transformation lenses 10*a* which constitute the lens array 10 around a rotation axis of each of the plurality of wavefront transformation lenses 10*a* and for changing the attitude of each of the plurality of wavefront transformation lenses 10*a*.

Next, a description will be made as to the operation of the multibeam antenna apparatus according to embodiment 4 of the present invention. As shown in FIG. 6, the amount of distortion of a position onto which an electric wave emitted from each primary radiator 5*a* which is disposed apart from the center of the primary radiator array 5 is focused after being directly incident upon a focused beam feeder 3 varies somewhat according to the view rotation angle. This means that it is impossible to perfectly prevent an error from occurring in the orientation of each beam only by holding the attitude of each of the plurality of wavefront transformation lenses 10*a* regardless of the view rotation angle, as in the case of above-mentioned embodiment 3. The amount of distortion of a position onto which an electric wave emitted from each primary radiators 5*a* which is disposed apart from the center of the primary radiator array 5 is focused after being directly incident upon the focused beam feeder 3 includes the amount of displacement due to the view rotation, which is determined by the structure of the focused beam feeder 3, the shapes of the focusing reflectors 3*a* to 3*d*, and the distance between each primary radiators 5*a* and the center of the primary radiator array 5. When the amount of displacement due to the view rotation cannot be neglected, a desired degree of accuracy is not provided for the orientation of each beam.

In accordance with this embodiment 4, the multibeam antenna apparatus can change the attitude of each of the plurality of wavefront transformation lenses 10*a* after rotating the primary radiator array 5 and the lens array 10 for view rotation correction and further rotating each of the plurality of wavefront transformation lenses 10*a* which constitute the lens array 10 around a rotation axis of each of the plurality of wavefront transformation lenses 10*a*, like that of above-mentioned embodiment 3.

Therefore, when a view rotation correction is made, the orientation of each beam does not vary even if the view rotation angle changes, and an error can be further prevented from occurring in the orientation of each beam, as compared with above-mentioned embodiment 3.

Many widely different embodiments of the present invention may be constructed without departing from the spirit and scope of the present invention. It should be understood that the present invention is not limited to the specific embodiments described in the specification, except as defined in the appended claims.

What is claimed is:

1. A multibeam antenna apparatus including a main reflector, a sub-reflector, a focused beam feeder, and a primary radiator array having a plurality of primary radiators, said apparatus comprising:

a lens array having a plurality of wavefront transformation lenses corresponding one-to-one to said plurality of primary radiators, respectively.

2. The multibeam antenna apparatus according to claim 1, wherein said lens array is placed in the vicinity of a front end of said primary radiator array.

3. The multibeam antenna apparatus according to claim 2, wherein said lens array and said primary radiator array can be rotated for view rotation correction, and each of said plurality of wavefront transformation lenses can be rotated around a rotation axis thereof according to an amount of rotation of said lens array.

4. The multibeam antenna apparatus according to claim 2, wherein said lens array and said primary radiator array can be rotated for view rotation correction, and each of said plurality of wavefront transformation lenses can be rotated around a rotation axis thereof according to an amount of rotation of said lens array and can be changed in attitude.

5. The multibeam antenna apparatus according to claim 1, wherein said lens array is placed in an electric wave propagation range of said focused beam feeder where multiple beams are spatially isolated from one another in terms of electric power.

6. The multibeam antenna apparatus according to claim 5, wherein said lens array and said primary radiator array can be rotated for view rotation correction, and each of said plurality of wavefront transformation lenses can be rotated around a rotation axis thereof according to an amount of rotation of said lens array.

7. The multibeam antenna apparatus according to claim 5, wherein said lens array and said primary radiator array can be rotated for view rotation correction, and each of said plurality of wavefront transformation lenses can be rotated around a rotation axis thereof according to an amount of rotation of said lens array and can be changed in attitude.

* * * * *